US006610914B2

(12) United States Patent
Yasunaga

(10) Patent No.: US 6,610,914 B2
(45) Date of Patent: Aug. 26, 2003

(54) PIANO

(76) Inventor: Ueno Yasunaga, 507-4, Katsubecho, Moriyama-shi, Shiga-Ken (JP)

( * ) Notice: Subject to any disclaimer, the term of this patent is extended or adjusted under 35 U.S.C. 154(b) by 0 days.

(21) Appl. No.: 10/026,164

(22) Filed: Dec. 21, 2001

(65) Prior Publication Data

US 2002/0096034 A1 Jul. 25, 2002

(30) Foreign Application Priority Data

Jan. 25, 2001 (JP) ..... 2001-059259

(51) Int. Cl.[7] ..... G10C 1/00
(52) U.S. Cl. ..... 84/174
(58) Field of Search ..... 84/174, 176, 177, 84/184, 185, 186.1, 239

(56) References Cited

U.S. PATENT DOCUMENTS 4,127,051 A * 11/1978 Conklin, Jr. ..... 84/423 R
4,130,044 A * 12/1978 Yamada et al. ..... 84/176

FOREIGN PATENT DOCUMENTS

DE 2707979 C2 12/1982
JP 54119227 * 9/1979

* cited by examiner

*Primary Examiner*—Shih-Yung Hsieh
(74) *Attorney, Agent, or Firm*—Jiawei Huang; J. C. Patents

(57) ABSTRACT

A sonic-vibration-generating mechanism of a piano is divided into a two-segment structure made up of the sonic-vibration-generating mechanism of the upstream side A and the sonic-vibration-generating mechanism of the downstream side B, and the sonic-vibration-generating mechanism of the downstream side is placed in a layered state onto the sonic-vibration-generating mechanism of the upstream side, with a plural number of weight-supporting elements of a point-support type or a line-support type allocated in between in rows at certain uniform intervals on the support frame 19 installed in the sonic-vibration-generating mechanism of the upstream side A.

4 Claims, 5 Drawing Sheets

PIANO

BACKGROUND OF INVENTION

1. Field of the Invention

The present invention gives means to give a better structure of the main body of a piano in order to improve sound quality and sound separation capability of the piano, and, more particularly, the invention gives means to improve sound quality and sound separation capability of a piano by making the main body of a piano into a separable two-segment structure, one being the sonic-vibration-generating mechanism of the upstream side made up of a keyboard mechanism, a pedal mechanism and so on that functions as a source to produce energy to strike strings and the other being the sonic-vibration-generating mechanism of the downstream side incorporated to receive the energy to strike strings transmitted from the sonic-vibration-generating mechanism of the upstream side, transform it into sonic vibrations and then emit from the main body of the piano into the air the energy of thus generated sonic vibrations as sonic waves, and forming a support structure for the main body of the piano with weight-supporting elements of a point-support type or a line-support type or weight-supporting elements of a non-contact type composed of a magnet-lifting mechanism or a pneumatic spring allocated between the sonic-vibration-generating mechanism of the upstream side and the sonic-vibration-generating mechanism of the downstream side, thereby making it possible for the sonic-vibration-generating mechanism of the downstream side to keep the freedom of vibration which is effective to improve sound quality even when an excessively big energy to strike strings is loaded on the sonic-vibration-generating mechanism of the upstream side.

2. Prior Art

As shown in FIG. 5, a conventional grand piano for concert use contains, inside the case 36 of the grand piano P supported by legs 4, the sonic-vibration-generating mechanism of the upstream side A made up of a keyboard mechanism, an action mechanism and others that functions as a source to produce energy to strike strings and the sonic-vibration-generating mechanism of the downstream side B made up of a damper mechanism, tuning pins, hitch-pins, a bridge, a soundboard, ribs, a frame, strings, and a lid that receives the energy to strike strings transmitted from the sonic-vibration-generating mechanism of the upstream side A, generates sonic vibrations and emits into the air the energy of thus generated sonic vibrations as sonic waves. Also, onto the bottom face of the main body of a grand piano, is mounted a pedal mechanism made up of a forte pedal, a sostenuto pedal and a shift pedal, as a constituent part of the sonic-vibration-generating mechanism of the upstream side A.

In a conventional grand piano, as shown in FIG. 5, both the sonic-vibration-generating mechanism of the upstream side A and the sonic-vibration-generating mechanism of the downstream side B were incorporated into the main body of a grand piano P as a unified structure that cannot be separated.

When a pianist plays a conventional grand piano P shown in FIG. 5, if the pianist hits and presses keys strongly to the lowest limit of the key-dip and keeps pressing them as they are, a big pressure weight is loaded on the constituent parts of the sonic-vibration-generating mechanism of the upstream side A. Since the sonic-vibration-generating mechanism of the downstream side B is jointed to the sonic-vibration-generating mechanism of the upstream side A as a unified structure, the big pressure weight loaded on the sonic-vibration-generating mechanism of the upstream side A is uncontrollably transmitted to the sonic-vibration-generating mechanism of the downstream side B. Consequently, a strain of the order of microns is transmitted not only to the constituent parts of the sonic-vibration-generating mechanism of the upstream side A but also to those of the sonic-vibration-generating mechanism of the downstream side B. This strain of the order of microns transmitted to the sonic-vibration-generating mechanism of the downstream side B is, in a sense, produced irrespective of the performing skill of the pianist, and the constituent parts of the sonic-vibration-generating mechanism of the downstream side B such as a damper mechanism, tuning pins, hitch-pins, a bridge, a soundboard, ribs, a frame, strings and a lid are prevented from vibrating freely in the horizontal and vertical directions and, thus, a distortion is produced in the wave form of the sonic vibrations emitted into the air from the sonic-vibration-generating mechanism of the downstream side B. Thereby, troubles such as smothered or voiced sound, sonority decrease, or reduced capability of sound separation are caused to occur to the sound emitted into the air from the sonic-vibration-generating mechanism of the downstream side B.

Hitherto is described the troubles caused to occur to the sonic-vibration-generating mechanism of the downstream side B when the keys are hit and pressed strongly to the lowest limit of the key-dip. Likewise, such deterioration of sound quality and sound separation capability is also caused when a forte pedal, a shift pedal or other of the pedal mechanism is strongly pressed to the lowest limit of its stroke and kept pressing it as it is, and, thus, a distortion is produced in the wave form of the sonic vibrations emitted from the sonic-vibration-generating mechanism of the downstream side B, causing troubles such as deterioration of sound quality. Such deterioration of sound quality and sound separation capability is, in a sense, an uncontrollable trouble produced irrespective of the performing ability of a pianist or the tuning ability of a tuning technician in case of a conventional grand piano, and, therefore, it has long been requested to establish means to solve this problem by most pianists and tuning technicians.

SUMMARY OF THE INVENTION

As a means to solve the foregoing problem, the present invention gives a piano that is formed by dividing the main body of the piano, which is used to be made as a unified structure, into two parts, one being the sonic-vibration-generating mechanism of the upstream side and the other being the sonic-vibration-generating mechanism of the downstream side, thus making the main body of the piano into a two-segment structure, then allocating in rows at certain uniform intervals a plural number of either weight-supporting elements of a point-support type or a line-support type or weight-supporting elements of a non-contact type composed of a magnet-lifting mechanism or a pneumatic spring on the support frame installed in the sonic-vibration-generating mechanism of the upstream side, and, with these weight-supporting elements in between, placing in a layered state the sonic-vibration-generating mechanism of the downstream side onto the sonic-vibration-generating mechanism of the upstream side.

The sonic-vibration-generating mechanism of a piano is divided into two parts, one being the sonic-vibration-generating mechanism of the upstream side A made up of a keyboard mechanism, an action mechanism, a damper mechanism and others that functions as a source to produce energy to strike strings and the other being the sonic-vibration-generating mechanism of the downstream side B made up of tuning pins, hitch-pins, a bridge, a soundboard, ribs, a frame, strings, a lid and others that receives the energy to strike strings transmitted from the sonic-vibration-generating mechanism of the upstream side A, generates sonic vibrations and emits from the main body of the piano into the air the energy of thus generated sonic vibrations as sonic waves; a plural number of weight-supporting elements C of a point-support type or a line-support type or weight-supporting elements C of a non-contact type composed of a magnet-lifting mechanism or a pneumatic spring are allocated in rows at certain uniform intervals on the support frame installed in the sonic-vibration-generating mechanism of the upstream side; and, with these weight-supporting elements C in between, the sonic-vibration-generating mechanism of the downstream side B is placed in a layered state onto the sonic-vibration-generating mechanism of the upstream side A. Thereby, the freedom of vibration of the sonic-vibration-generating mechanism of the downstream side B is secured and the distortion of the wave form of the sonic vibrations emitted from the sonic-vibration-generating mechanism of the downstream side B is prevented.

DETAILED DESCRIPTION OF THE PREFERRED EMBODIMENTS

EXAMPLE 1

Figure 1:
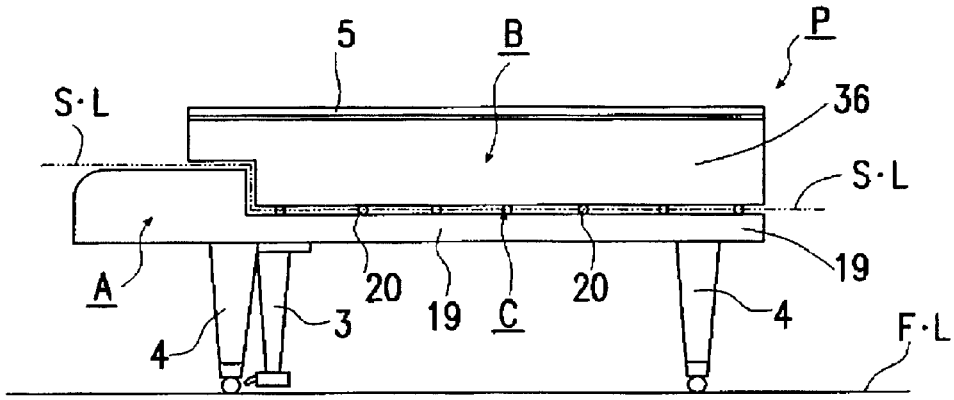
FIG. 1 is a side-view explaining the whole structure of the grand piano in accordance with the invention.

Hereinafter, an example where this invention is applied to a grand piano P for concert use will be explained with reference to FIG. 1 to FIG. 3.

The main body of a grand piano P, including the case 36 itself, is divided into two parts, one being the sonic-vibration-generating mechanism of the upstream side A made up of a keyboard mechanism 1, a pedal mechanism 3, an action mechanism 2 and legs 4 that functions as a source to produce energy to strike strings and the other being the sonic-vibration-generating mechanism of the downstream side B made up of a damper mechanism 6, tuning pins 8, hitch-pins (not shown in the Figure), a bridge 35, a soundboard 7, ribs (not shown in the Figure), a frame 9, strings 10, and a lid 5 that receives the energy to strike strings transmitted from the sonic-vibration-generating mechanism of the upstream side A, generates sonic vibrations and emits from the main body of the grand piano into the air the energy of thus generated sonic vibrations as sonic waves. The separating line that separates the sonic-vibration-generating mechanism of the upstream side A from the sonic-vibration-generating mechanism of the downstream side B is indicated in FIG. 1 and FIG. 2 with a reference mark SL.

The key mechanism 1 supports a key 1A through a balance rod 17 mounted on the key bed 18 so as for the key to move freely in the vertical direction, and, the action mechanism 2, placed above the base end of the key 1A as a means to convey energy to strike strings, supports a hammer 12 so as for the hammer to be able to move up and down under a string 10.

Figure 2:
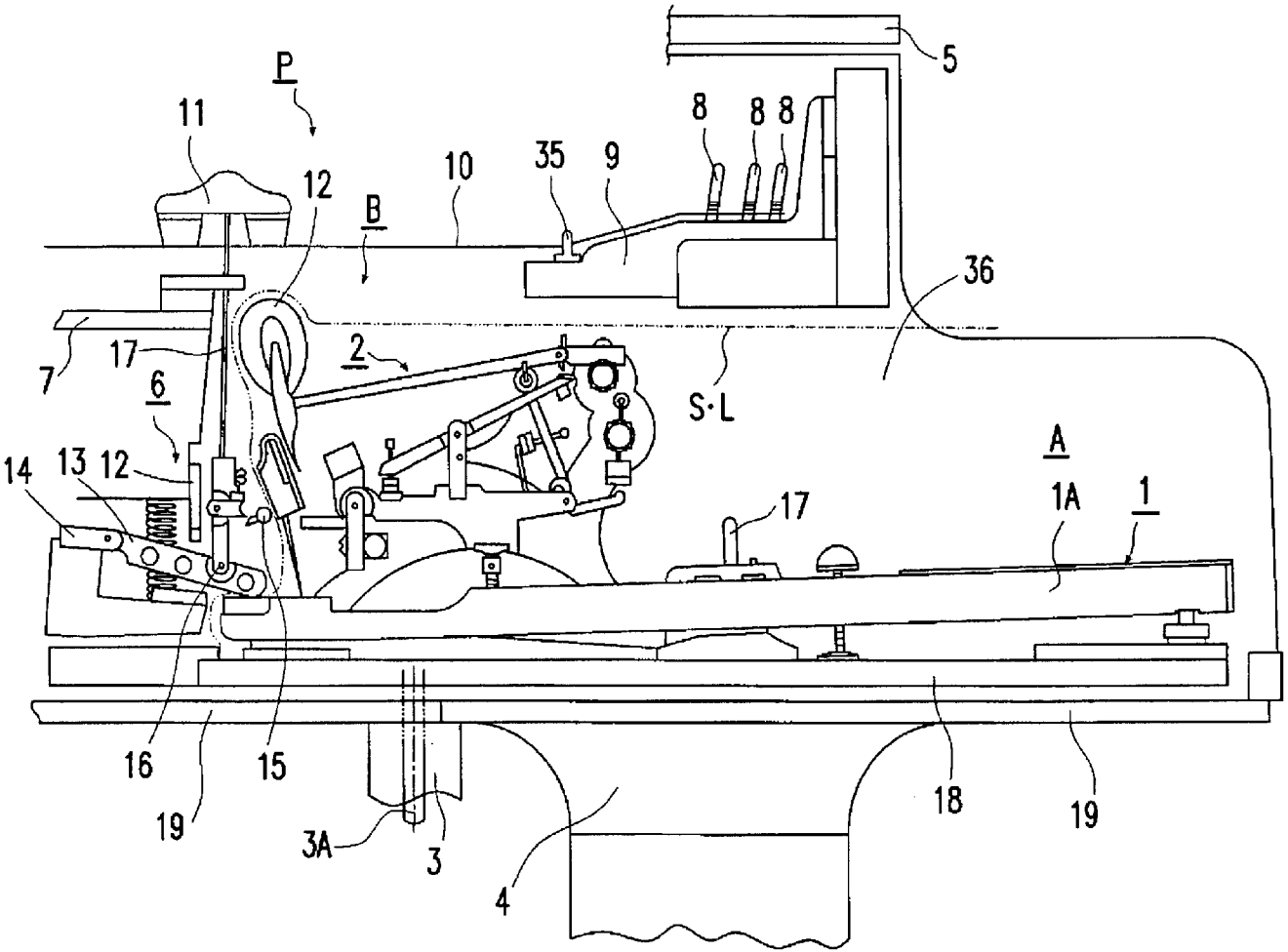
FIG. 2 is a longitudinal cross-section view of the major part of the grand piano showning Example 1.

On the other hand, under the string 10 is placed, side-by-side with the action mechanism 2, a damper mechanism 6 that operates by pressing down one of the constituent parts, that is, a forte pedal, a sostenuto pedal or a shift pedal of the pedal mechanism 3 (its rod part is shown with a representative number 3A in FIG. 2). The damper mechanism 6 is formed, according to the ordinary method, with such parts as a damper lever 13, a damper-lever flange 14, a sustaining rod 15, a damper-stop rail 12, a damper wire 17 and so on, the top end of the damper wire 17 being connected with a damper head 11 over a string 10.

In the present invention, the freedom of vibration in the sonic-vibration-generating mechanism of the downstream side B is maintained to a predetermined level irrespective of the amount of energy to strike strings transmitted from the sonic-vibration-generating mechanism of the upstream side A and, therefore, a distortion of the wave form of the sonic vibration emitted into the air is effectively prevented from being produced, by means of allocating a plural number of weight-supporting elements 20 of a point-support type or a line-support type in rows at certain uniform intervals on the support frame 19 installed in the sonic-vibration-generating mechanism of the upstream side A as shown in FIG. 1 and FIG. 2 with a representative symbol C, and, with these weight-supporting elements 20 in between, placing in a layered state the sonic-vibration-generating mechanism of the downstream side B onto the sonic-vibration-generating mechanism of the upstream side A.

Figure 3:
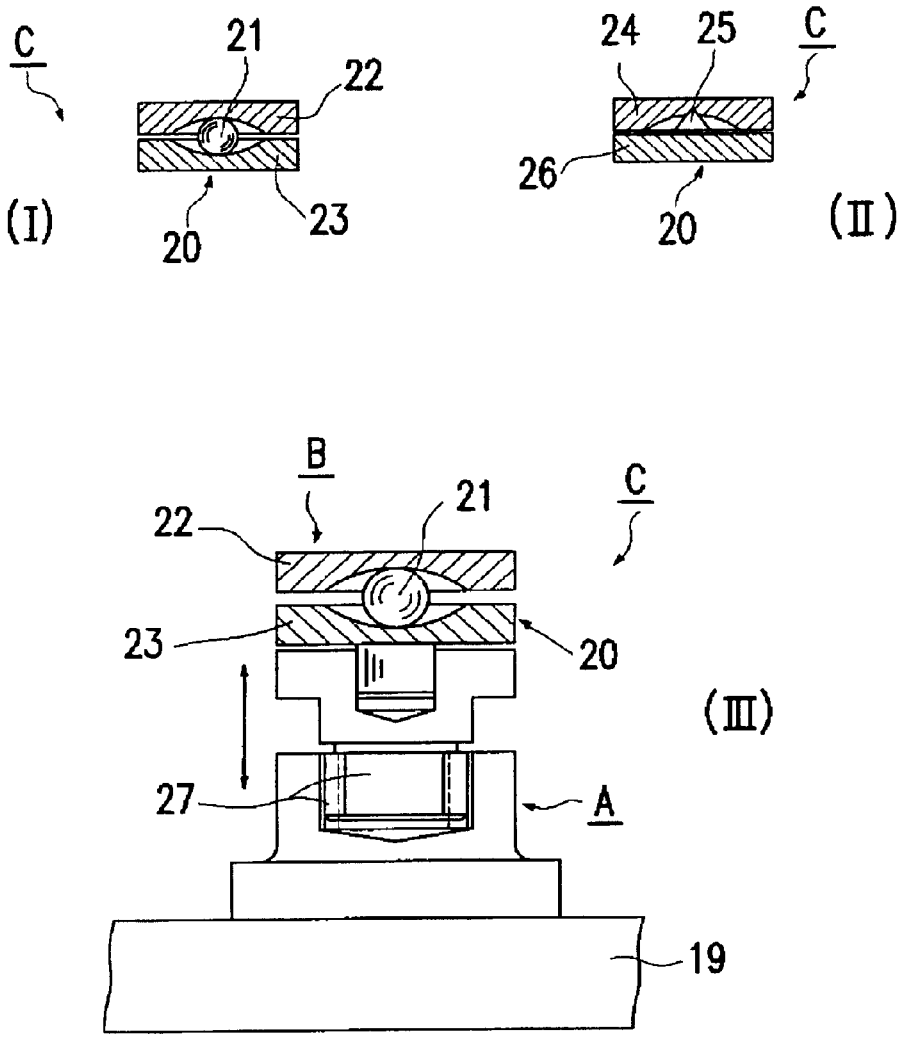
FIG. 3 is a brief longitudinal cross-section views of a weight-supporting elements of a point-support type or a line-support type.

A weight-supporting element 20 of a point-support type depicted in FIG. 3(I) is formed into a weight-receiving part of a point-support type of an automatic center-controlling kind by putting a steel ball between a set of two weight-receiving parts 22 and 23 having a concave receiving surface on the bottom and top faces respectively so as for the steel ball to rotate freely. Also, a weight-supporting element 20 of a line-support type depicted in FIG. 3(II) is formed into a weight-receiving part of a line-support type by arranging, face to face with each other, a weight-supporting element 26 of the lower side having a knife edge 25 fixed on its top face and a weight-supporting element 24 of the upper side having a groove for the knife edge 25 to fit in on its bottom face.

The weight-supporting element 20 of a line-support type depicted in FIG. 3 with a representative symbol C is, because of its simple structure and easy handling, evaluated for its usefulness as a weight-supporting element that gives to the sonic-vibration mechanism of the downstream side B of a grand piano P a function to vibrate freely along in the horizontal and vertical directions. But, instead, a weight-supporting element of a non-contact type that is formed with a weight supporting mechanism of a magnet-lifting type composed of a set of two permanent magnets of the same polarity, or a pneumatic spring may be employed.

Hitherto, the basic structure of a weight-supporting element C of a point-support type or a line-support type has been explained with reference to FIG. 3 (I) (II) and the sonic vibration produced is greatly influenced by the weight of the sonic-vibration-generating mechanism of the upstream side A and that of the sonic-vibration-generating mechanism of the downstream side B both loaded on the support frame 19 directly or through weight-supporting elements C respectively. More particularly, the support frame 19 is installed over three legs 4 fixed underneath the main body of a piano, as a beam shaped material for bearing dispersed weights. Therein, there exists a delicate variation in the amount of the dispersed weight exerted from the main body of the piano, between the support frame 19 positioned right on the legs that functions as a major supporting point of the weight and the support frame 19 positioned in the middle between the legs 4 that functions as a minor supporting point, and, thereby, the amount of bend of the support frame 19 in the vertical direction at each weight-supporting element C varies from place to place in the order of microns. This variation of the amount of bend in the vertical direction produced in the support frame 19 affects the acoustic characteristic of the sonic-vibration-generating mechanism of the upstream side A and the sonic-vibration-generating mechanism of the downstream side B, which are supported by the weight-supporting elements C and the support frame 19. Namely, when the amount of load of the dispersed weight at each weight-supporting element C varies from place to place, through the variation of the amount of bend in the vertical direction produced at each weight-supporting element C, a distortion is caused in the wave form of the sonic vibration produced and emitted from the sonic-vibration-generating mechanism of the upstream side A and the sonic-vibration-generating mechanism of the downstream side B, and, hence, the acoustic characteristic that the piano P originally possesses deteriorates.

In order to avoid such disadvantage, the plural number of weight-supporting elements of a point-support type or a line-support type C are, as shown in FIG. 3 (III), preferably formed with weight-supporting elements of a telescopic structure 27 with which the vertical height dimension at a weight-supporting point can be adjusted according to a varied amount of the dispersed weight exerted by the sonic-vibration-generating mechanism of the upstream side A and the sonic-vibration-generating mechanism of the downstream side B.

EXAMPLE 2

Figure 4:
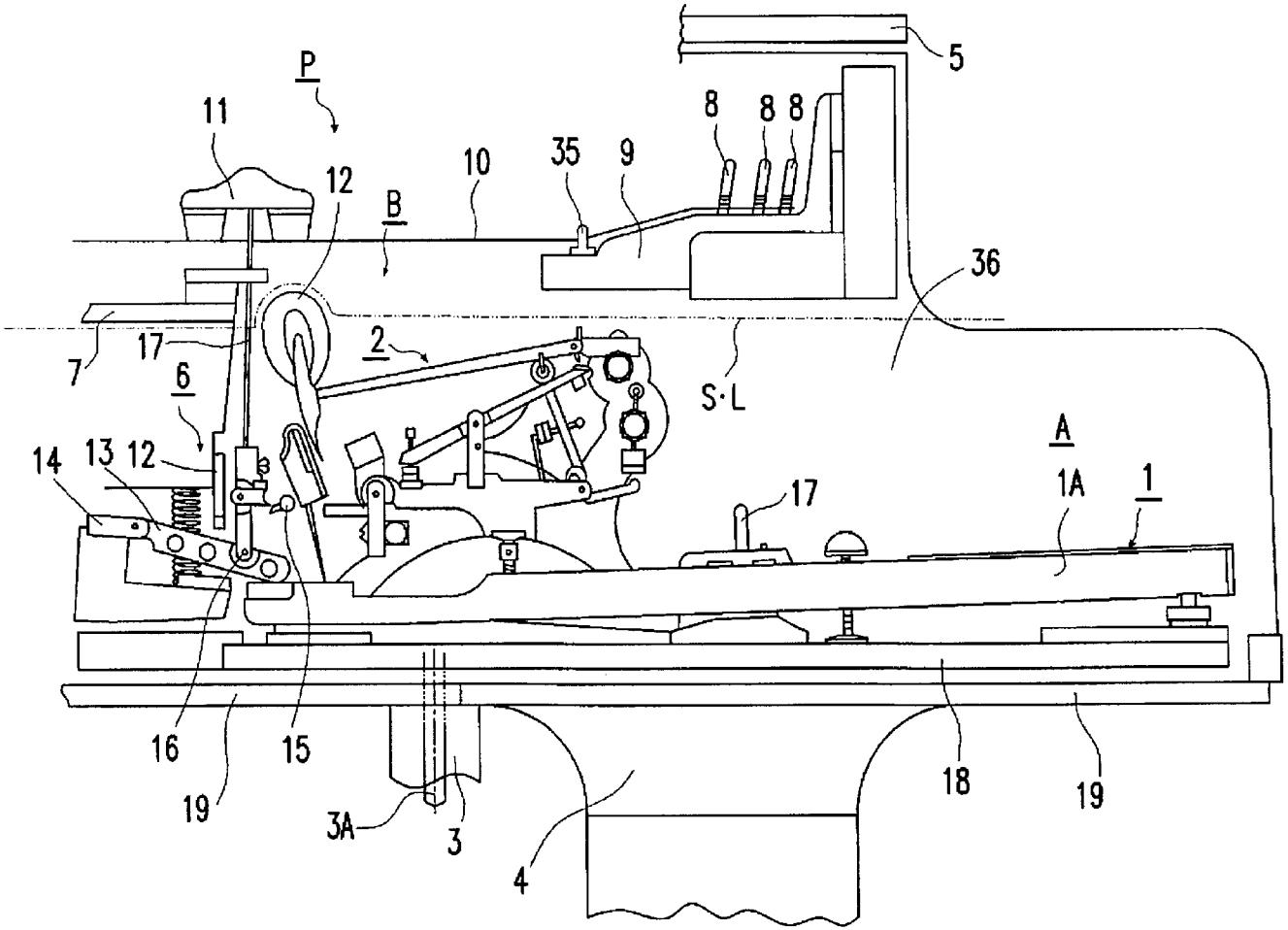
FIG. 4 is a longitudinal cross-section view of the major part of the grand piano showning Example 2.
Figure 5:
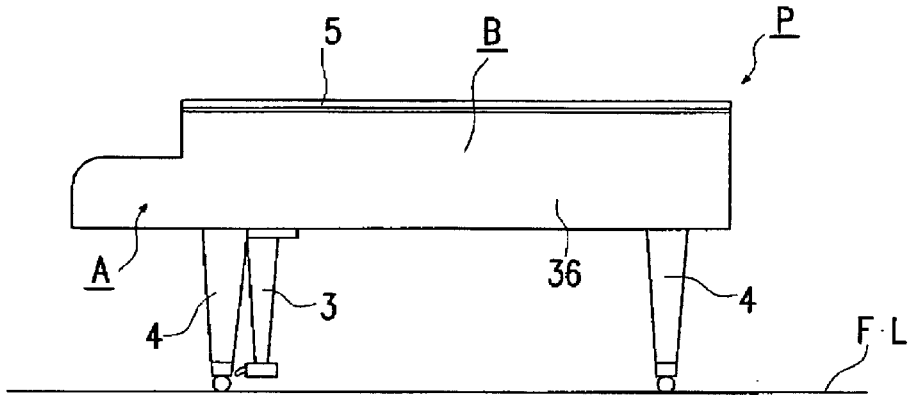
FIG. 5 (PRIOR ART)
FIG. 5 is a side-view explaining the whole structure of a conventional grand piano.

In FIG. 4 is shown another form of example where some of the constituent parts of the sonic-vibration-generating mechanism of the upstream side A and the sonic-vibration-generating mechanism of the downstream side B are interchanged in the grand piano P described above in Example 1. In this example, the damper mechanism 6 that was originally set in the sonic-vibration-generating mechanism of the downstream side B as in Example 1, is transferred to the sonic-vibration-generating mechanism of the upstream side A in order to make it possible to take out of the case 36 as a unified structure the constituent parts of the sonic-vibration-generating mechanism of the downstream side B; tuning pins 8, hitch-pins 34, a bridge 35, a soundboard 7, ribs (omitted in the Figure), a frame 9, and strings 10. Corresponding to this structure change, the separating line SL that shows the boundary between the sonic-vibration-generating mechanism of the upstream side A and the sonic-vibration-generating mechanism of the downstream side B is drawn at a location partly different from that in Example 1.

According to this Example, when each constituent part such as a frame 9 or a soundboard 7 of the sonic-vibration-generating mechanism of the downstream side B is taken out of the main body of the grand piano P, the interference between the sonic-vibration-generating mechanism of the upstream side A and the sonic-vibration-generating mechanism of the downstream side B is eliminated and, therefore, a large-scale reform of a grand piano P for the purpose of change in sound quality or other can be carried out with great ease, and a remarkable effect is obtained in securing a variety of sound tone.

According to this invention, nearly perfectly avoided is the problem that was supposed to be inevitable for a conventional piano, namely, the disadvantage that the free vibration of the sonic-vibration-generating mechanism of the downstream side B is prohibited because of a strain in the order of microns produced in the sonic-vibration-generating mechanism of the upstream side A when the keys 1A of the key mechanism 1 are pressed strongly to the lowest limit of the key-dip or a pedal 3A of the pedal mechanism 3 is strongly pressed to the lowest limit of its stroke. Consequently, a distortion is eliminated from the wave form of the sonic vibration emitted into the air from the main body of the piano, and thereby the sonority and sound separation capability are improved. As a result of improved sonority, not only is the dynamic range of sound volume enlarged over the whole range of frequency from bass to treble, but also the variety of sound tone such as hardness and softness, brightness and darkness, reach, thickness and so on can be secured, and accordingly an excellent performing effect is exhibited.

Also, as a secondary effect of the invention, by making the sonic-vibration-generating mechanism of the upstream side A and the sonic-vibration-generating mechanism of the downstream side B into two separable different structures, the exchange and repair of the constituent parts such as an action mechanism 2, a soundboard 7, a frame 9 and strings 10 can be done more easily and a remarkable effect on cutting the manufacturing cost of a piano is exhibited. A remarkable effect on increasing the precision of tuning is also exhibited because the sound separation capability is highly improved.

What is claimed is:

1. A piano comprising a main body, said main body being divided into two parts, one part being a sonic-vibration-generating mechanism of an upstream side made up of a keyboard mechanism, a pedal mechanism, an action mechanism, and legs that functions as a source to produce energy to strike strings and another part being a sonic-vibration-generating mechanism of a downstream side made up of a damper mechanism, tuning pins, hitch-pins, a bridge, a soundboard, ribs, a frame, the strings, and a lid that receives the energy to strike the strings transmitted from said sonic-vibration-generating mechanism of the upstream side, generates sonic vibrations and emits into the air the energy of thus generated sonic vibrations as sonic waves, in rows at certain uniform intervals are allocated a plural number of either weight-supporting elements of a point-support type or a line-support on a support frame installed in said sonic-vibration-generating mechanism of the upstream side, and, with these weight-supporting elements in between, said sonic-vibration-generating mechanism of the downstream side is placed in a layered state onto said sonic-vibration-generating mechanism of the upstream side.

2. A piano as set forth in claim 1, wherein the plural number of weight-supporting elements of the point-support type or the line-support type which are allocated on the support frame installed in said sonic-vibration-generating mechanism of the upstream side as parts to support the weight of said sonic-vibration-generating mechanism of the downstream side are formed with the weight-supporting elements of a telescopic structure that enable to change a vertical height dimension at a weight-supporting point according to a change in the weights of said sonic-vibration-generating mechanism of the upstream side and the sonic-vibration-generating mechanism of the downstream side.

3. A piano comprising a main body, said main body being-divided into two parts, one part being a sonic-vibration-generating mechanism of an upstream side made up of a keyboard mechanism, a pedal mechanism, an action mechanism, a damper mechanism, and legs that functions as a source to produce energy to strike strings and another part being a sonic-vibration-generating mechanism of a downstream side made up of tuning pins, hitch-pins, a bridge, a soundboard, ribs, a frame, the strings, and a lid that receives the energy to strike the strings transmitted from said sonic-vibration-generating mechanism of the upstream side, generates sonic vibrations and emits into the air the energy of thus generated sonic vibrations as sonic waves, in rows at certain uniform intervals are allocated a plural number of either weight-supporting elements of a point-support type or a line-support type on a support frame installed in said sonic-vibration-generating mechanism of the upstream side, and, with these weight-supporting elements in between, said sonic-vibration-generating mechanism of the downstream side is placed in a layered state onto said sonic-vibration-generating mechanism of the upstream side.

4. A piano as set forth in claim 3, wherein the plural number of weight-supporting elements of the point-support type or the line-support type which are allocated on the support frame installed in said sonic-vibration-generating mechanism of the upstream side as parts to support the weight of said sonic-vibration mechanism of the downstream side are formed with the weight-supporting elements of a telescopic structure that enable to change a vertical height dimension at a weight-supporting point according to a change in the weight of said sonic-vibration-generating mechanism of the upstream side and the sonic-vibration-generating mechanism of the downstream side.

* * * * *